United States Patent [19]

Finnegan

[11] 4,326,747

[45] Apr. 27, 1982

[54] SKI CARRIER

[75] Inventor: Robert J. Finnegan, Williston, Vt.

[73] Assignee: Barreca Products Co., Inc., Shelburne, Vt.

[21] Appl. No.: 210,244

[22] Filed: Nov. 25, 1980

Related U.S. Application Data

[63] Continuation of Ser. No. 20,747, Mar. 15, 1979, abandoned.

[51] Int. Cl.[3] ..... B65D 71/00; A45F 5/00

[52] U.S. Cl. ..... 294/147; 70/19; 70/58; 211/60 SK; 224/917; 280/814

[58] Field of Search ..... 224/45.8, 917; 81/416, 81/417, 418; 294/3, 16, 26, 118, 147, 87.22, 62; 280/814, 815; 211/60 SK; 24/81 SK; 70/19, 58

[56] References Cited

U.S. PATENT DOCUMENTS

| | | | |
|---|---|---|---|
| D. 163,785 | 7/1951 | Amigone | 294/3 X |
| 271,043 | 1/1883 | Davis | 81/416 X |
| 579,347 | 3/1897 | Kellnor | 294/118 X |
| 790,411 | 5/1905 | Watrons | 294/31 R X |
| 883,388 | 3/1908 | Carlson | 294/62 |
| 1,755,463 | 4/1930 | Waddell | 294/62 |
| 2,305,156 | 12/1942 | Grubel | 29/436 X |
| 2,997,326 | 8/1961 | Daum | 294/16 |
| 3,086,688 | 4/1963 | Vikre | 280/814 X |
| 3,263,535 | 8/1966 | Zurcher | 294/16 |
| 3,643,810 | 2/1972 | Highberger | 211/60 SK |
| 3,692,218 | 9/1972 | Friedman | 294/165 |
| 3,935,977 | 2/1976 | Bonnett | 280/814 X |
| 3,985,275 | 10/1976 | Allen | 280/814 |
| 3,990,655 | 11/1976 | Covell | 280/814 X |
| 4,057,983 | 11/1977 | Morgan | 280/814 X |
| 4,059,209 | 11/1977 | Grisel | 211/60 SK X |
| 4,099,315 | 7/1978 | Pudenz | 81/416 X |

*Primary Examiner*—Allan N. Shoap

*Attorney, Agent, or Firm*—Hopgood, Calimafde, Kalil, Blaustein & Judlowe

[57] ABSTRACT

The invention contemplates a tong-like portable carrier having facing jaw cavities on one side of its articulation axis for removable retention of a pair of skis, and facing jaw cavities in the other side of said axis for removable retention of a pair of ski poles. Handle frames provide registering openings which accommodate the insertion of fingers of one hand for a single grasp of both frames when the carrier is in its closed position. Various latching, locking and article-retaining features are described.

28 Claims, 6 Drawing Figures

SKI CARRIER

This application is a continuation of copending application Ser. No. 020,747, filed Mar. 15, 1979, now abandoned.

BACKGROUND OF THE INVENTION

The invention relates to a portable carrier for a pair of skis and a pair of ski poles, and to safe retention of the same.

Various devices have in the past been proposed for the unitary retention of a pair of skis and a pair of ski poles, for ready portability and ease of operation. Several of these prior devices rely upon hinged articulation of parts, there being exposed ski-accommodating and ski-pole-accommodating cavities when parts are moved to "open" condition, and these cavities being closed to retain the skis and the poles when the parts are articulated to "closed" position. Of these hinged devices, U.S. Pat. Nos. 3,892,343 (Warner) and 4,059,209 (Grisel) are illustrative of a so-called clam-shell variety wherein like opposed frames are hinged at one end and have ski-receiving and pole-receiving cavities which cooperate in the closed position to retain the skis and the poles, the closed position being retained by removable fastening of the unhinged ends. And U.S. Pat. No. 3,990,655 is illustrative of a further hinged variety, involving a central upstanding frame to which the opposite sides of separate ski and pole retaining side panels are hinged, at the bottom edge of the central frame. In all cases, multiple cavity levels are interposed between hinge and fastening locations, thus dictating a multiple-cavity span of panel or shell parts, with attendant structural complexity and use of materials or numbers of parts to achieve given security and portability requirements.

BRIEF SUMMARY OF THE INVENTION

It is an object of the invention to provide an improved ski carrier of the character indicated, featuring simplicity of construction and ease of operation.

Another object is to achieve the foregoing object with economy in the use of materials and numbers of parts.

A specific object is to provide such a carrier with an inherently shorter cavity span for hinged parts, between hinge and fastening locations.

Another specific object is to provide a carrier meeting the above objects and providing positive locking of the ski-retaining region, on both sides of and limited to the ski-retaining region.

Still another specific object is to achieve the above objects with a construction in which handle formations integral with each of the hinged parts are in register and cooperate as a single carrying handle when the carrier is in closed position.

The foregoing objects and other features are realized by the invention, involving two tong-like body members each of which has facing jaw cavities on opposite sides of a single articulation axis, located between a pair of ski-receiving cavities on one side of the articulation axis and a pair of pole-receiving cavities on the other side of the articulation axis, with means to releasably secure both outer ends of the body members.

DESCRIPTION OF A PREFERRED EMBODIMENT

A preferred embodiment of the invention will be illustratively described in conjunction with the accompanying drawings, in which.

Figure 1:
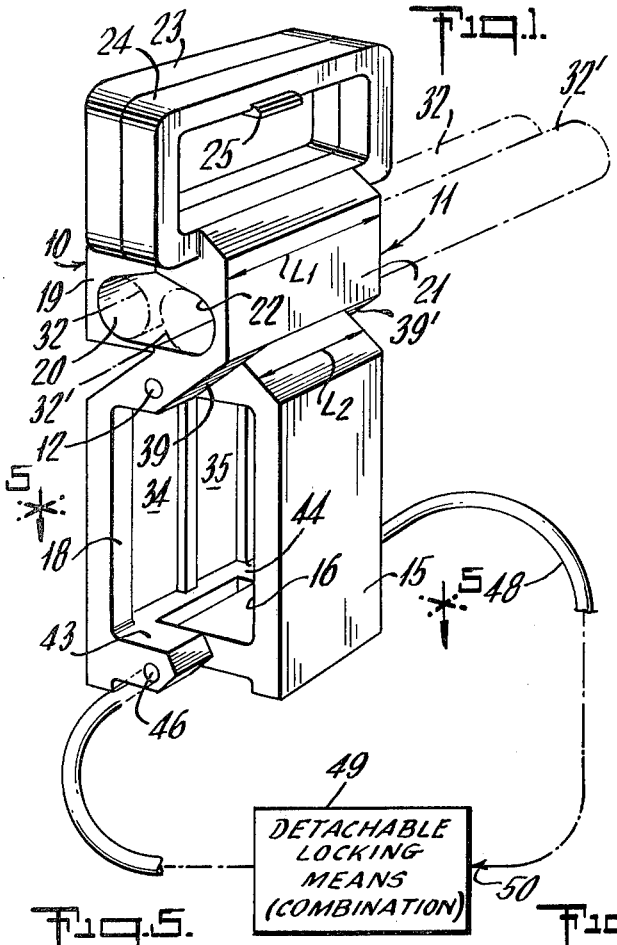
FIG. 1 is a perspective view of the body of a carrier for a pair of skis and a pair of ski poles, the body being shown in closed position.
Figure 2:
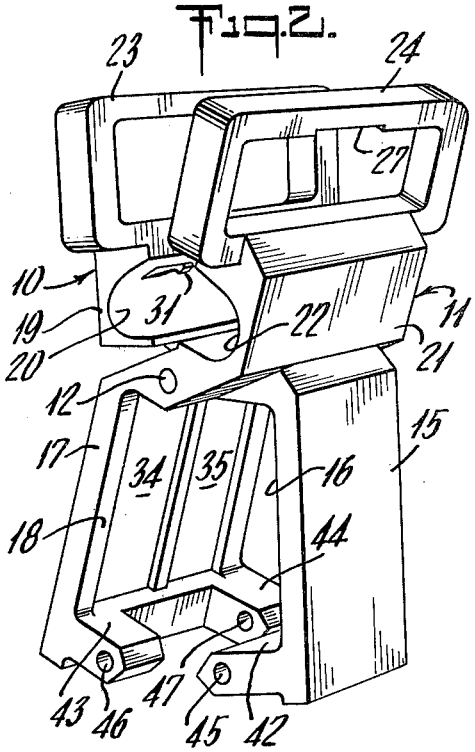
FIG. 2 is a perspective view of the carrier body of FIG. 1, but shown in open condition.

In FIGS. 1 and 2, the body of a carrier of the invention is seen to comprise two similar tong-like body members 10–11 which have articulated interconnection on a single axis, the same being provided by a pin 12 which is longitudinally retained in its passage through aligned pin bores 13–14 in the respective body members 10–11. The lower end of body member 10, i.e., below the pivot axis established by pin 12, constitutes a first jaw 15 having a generally rectangular cavity 16 which is elongate in the direction parallel to the pivot axis, and which is laterally open in the direction facing the corresponding jaw 17 of the other body member 11. Similarly, the second jaw 17 has a generally rectangular cavity 18 which faces jaw 15. In the closed relation of the carrier (FIG. 1), the jaw cavities 16–18 cooperatively define a single generally rectangular cavity which is elongate in the direction parallel to the pivot axis and which is of sectional proportions preferably more than adequate to contain the combined sectional area of the longitudinally central region of a pair of skis, abutted in face-to-face relation, as will later become more clear.

The upper end of body member 10, i.e., above the pivot axis established by pin 12, constitutes a further jaw 19 having a generally cylindrically arcuate cavity 20 which is elongate in the direction parallel to the pivot axis, and which is laterally open in the direction facing the corresponding jaw 21 of the other body member 11; jaw 21 is similarly provided with a generally cylindrically arcuate cavity 22, facing the cavity 20 when body members 10–11 are in closed relation.

Above the cavities 20 (22), each of the upper jaws 19 (21) includes a handle formation, shown as an elongate generally rectangular frame 23 (24) having an elongate generally rectangular opening proportioned to accommodate the fingers of one hand. When members 10–11 are in closed relation, the handle frames 23–24 are in abutting adjacency, with their openings in registration, so that a single one-handed grasp of both frames will inherently hold the closed relation of members 10–11. To releasably hold this relation, a latch tang 25 projects integrally as a stiffly compliant cantilever from frame 23; and a ramp 26 and a notched local recess 27 in frame 24 are positioned to coact with tang 25 in the course of closing body members 10–11 to their FIG. 1 relation, the coaction being first to transiently deflect and then to allow the latch of tang 25 to snap into recess 27, there being a small region of tang 25 projecting beyond frame 24 for ease of finger engagement to release a latched retention of frames 23–24, as when opening members 10–11 to their FIG. 2 relation.

For ski-pole retention, it is preferred (1) that the arcuate surface of cavity 20 (22) shall be offset laterally to the extent $D_1$ from the vertical plane of symmetry which includes the pivot axis, to provide a depth which will accommodate the largest longitudinally central diameter of a standard ski pole, and (2) that the laterally open contour of the cavity shall be characterized by divergent upper and lower tangent wall surfaces 29–30 (29'–30'). It is also preferred that one or more upwardly deflectable latch-detent tangs 31 (31') shall project integrally and laterally from the cavity to an effective extent $D_2$ (greater than half $D_1$ but less than $D_1$), in such manner as to provide detent retention of an inserted pole shaft, central fragments of two such shafts being suggested by phantom outlines 32 (32') in FIG. 1, in their respective retained orientations within cavities 20 (22). And it will be noted that the longitudinal supporting length $L_1$ afforded by each of the pole cavities 20 (22) is the same and relatively extensive, for equally effective longitudinally stable support of both poles, not only in the closed but also in the opened relation of the body members 10–11, so that each pole can be independently manipulated with ease, into and out of its detent-retained position.

It has been indicated that for ski retention by jaws 15–17, the combined effective open sectional area of cavities 16–18 preferably exceeds the combined sectional area of a central region of a pair of skis, when in face-to-face relation. The intent of this preferred relation is that resiliently compressible pad, buffer, or the like material or elements shall line the opposed bottom walls of cavities 16–18. In FIGS. 1 and 2, the bottom wall of cavity 18 is seen to have spaced upstanding locating grooves 34–35 for located reception of resiliently compressible members 36–37, which may be cut lengths of commercially available extruded elastomeric material.

Figure 4:
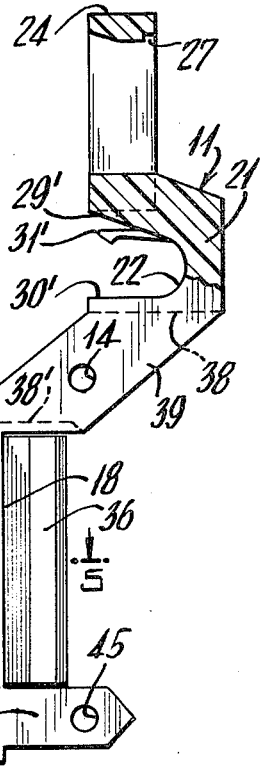

In the preferred form shown, the body member 10 is of substantially lesser longitudinal extent $L_2$ than the overall longitudinal extent $L_1$ of body member 11, and the articulation region of member 11 has a central opening of span slightly exceeding $L_2$ so as to accommodate the passage of jaw 15 therethrough, to the point of aligning the pivot bores 13–14 for permanent assembly of pin 12 thereto; upper and lower limits of this central opening in member 11 are indicated at dashed lines 38—38' in FIG. 4, between the strut formations 39—39' (FIG. 1) which integrally connect the upper and lower ends of body member 11. Permanent retention of pin 12 may be achieved by local knurling of pin 12 and its friction-fit or bonding to either or both of the outboard bores 14 of member 11 in the respective strut connections 39—39', but it is preferred that such local attachment shall be a friction-fit or bonding of pin 12 to the bore 13 of body member 10, leaving the outwardly projecting ends of pin 12 to have freely rotatable journaled support in the bores 13 of strut connections 39—39'.

Returning once more to FIG. 5, it is seen that in view of the reduced longitudinal extent $L_2$ of jaw 15, its upstanding inner wall has but a single groove 40, for mounted retention of an extruded resilient buffer 41, the latter being thus longitudinally intermediate the longitudinal centers of the buffers 36–37 which it faces. Illustratively, in FIG. 5, separately labeled thicknesses T in abutting adjacency will be understood to suggest the respective thicknesses of the respective skis of a given pair, at the longitudinally central region of their retention at cavities 16–18. More particularly, it will be understood that in the process of drawing handle frames 23–24 together, from their FIG. 2 open condition to their FIG. 1 closed condition, a pair of skis in face-to-face abutment and positioned in the space of and between cavities 16–18 will be firmly and resiliently engaged by compressed buffers 36–37–41, being thus retained as long as frames 23–24 remain latched by means 25.

The described tong-like formation and coaction of articulated body members 10–11 lends them additionally to provision of a security lock at nested interlace of a laterally extending projection 42 of member 10 between corresponding spaced bifurcated projections 43–44 of member 11. In the form of FIGS. 1 to 5, the projection 42 has a bore 45 parallel to the articulation axis, and the projections 43–44 have similar bores 46–47 which are in registering alignment when body members 10–11 are in their closed position. A removably inserted bolt or rod through these aligned bores 46–45–47 may be selectively locked in position to assure the retention of skis at cavities 16–18, but in FIG. 1 it is suggested schematically and by phantom lines that a loop 48 of flexible cable, e.g., as used for locking a bicycle to a lamp post or other fixed reference, may be passed through aligned bores 46–45–47 and that locking means 49 may detachably secure the ends of loop 48 to each other, for key-operated release or, as suggested by parenthetic legend at 49, for multi-digit combination-lock release; the arrowhead 50 shown at juncture of one end of cable 48 to locking means 49 will be understood to identify the cable end fitting which is releasably locked in its engagement with means 49, and this fitting will be understood to be of such diametric proportions as to be insertable through aligned bores 46–45–47.

Figure 5:
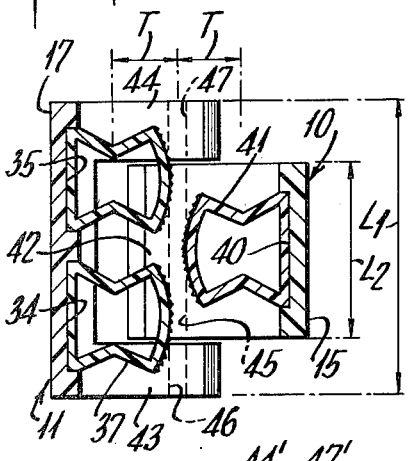
FIG. 5 is a sectional view, taken at the plane 5—5 of FIGS. 1, 3 and 4.
Figure 3:
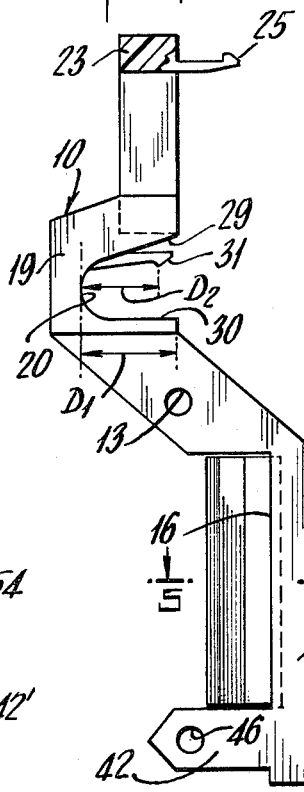
FIGS. 3 and 4 are corresponding views in side elevation, for the respective body parts of FIG. 1, certain parts being broken-away and in vertical section, for a better illustration of detail.
Figure 6:
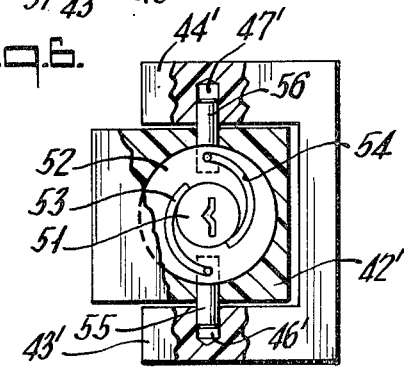
FIG. 6 is a bottom view of a modified carrier.

FIG. 6 shows an alternative locking means for aligned bores in interlaced projections 43'–42'–44' corresponding to those described at 46–45–47 in FIG. 5, these bores being identified by corresponding but primed notation in FIG. 6. The locking means of FIG. 6 is shown as a key-operated cylinder 51 which is effective to impart to a cam disc 52 a fraction of a rotational turn. Separate spiral cam slots 53 (54) have follower engagement to separate locking dead-bolt pins 55 (56), the same being shown in ski-locking position wherein pin 55 is a dead bolt having bridging engagement with adjacent aligned bores 46'–45' and wherein pin 56 is a dead bolt having bridging engagement with adjacent aligned bores 45'–47'; in the counterclockwise actuated condition of lock 51, the bolt pins 55 (56) are retracted from engagement with bores 46' (47'), to permit carrier opening upon disengagement of latch means 25.

It will be seen that the described invention amply meets all stated objects and, importantly, that it provides maximum security of ski gear with utmost simplicity and economy of parts. Separate releasable fastening is provided at outer ends of the respective cavity regions, and the central connection of the parts assures that no more than a single cavity region will be spanned between two adjacent connections of the body members. The described construction will also be seen to lend itself to plastic-injection molding for each of the respective body members as a whole, the same being suitably of ABS, polycarbonate or polypropylene material.

While the invention has been described in detail for the preferred embodiments shown, it will be understood that modifications may be made without departing from the claimed scope of the invention.

What is claimed is:

1. A ski carrier, comprising two similar unitary tong-like body members each having a handle at one end and a jaw at the opposite end, said members having an articulated connection on an axis located between the handle end and the jaw end, the handles being in abutting adjacency when in closed position and in angularly spaced relation when in open position, one of said body members having a continuously framed axially extensive opening at its region of said articulated connection, the region of said articulated connection of the other of said body members having between its articulation region and one of the ends of said other body member an axial extent which is of substantially the axial extent of the framed opening, the articulated connection of said body members being at both axial limits of the framed opening, each of the jaws having a ski-receiving cavity and the cavities of said jaws facing each other to define when in closed position a peripherally enclosed generally rectangular passage extending parallel to said axis and adapted to contain the combined central cross-section of a pair of skis in face-to-face relation when said body members are in closed position.

2. The ski carrier of claim 1, in which resiliently yieldable material is carried at the bottom wall of at least one of said cavities, whereby upon movement of said body members to closed position, a pair of skis may be resiliently retained by said jaws.

3. The ski carrier of claim 2, in which said resiliently yieldable material is carried at the opposed bottom walls of both cavities.

4. The ski carrier of claim 1, in which coacting latch means carried at corresponding end regions of said body members coact to releasably retain the closed position.

5. The ski carrier of claim 1, in which the handle of each body member is an open frame sized to accommodate through passage of the fingers of a hand, the open frames being in face-to-face registration when said body members are in closed position, whereby the fingers of a single hand necessarily pass through both said frames to grasp and retain said frames and therefore said body members in closed position.

6. The ski carrier of claim 5, in which corresponding handle regions of said body members include releasable latch means coacting to releasably retain the closed position.

7. The ski carrier of claim 1, in which coacting locking means carried at corresponding end regions of said body members coact to retain the closed position.

8. The ski carrier of claim 7, in which said locking means is of the multi-digit combination variety.

9. The ski carrier of claim 7, in which said locking means is key-operated.

10. The ski carrier of claim 1, in which one of said jaws has an outer-end region which is characterized by spaced bifurcated projections between which the corresponding end region of the other of said jaws is received and lapped when said body members are in closed position.

11. The ski carrier of claim 10, in which the lapped end regions of said jaws each have a locking bore, the locking bores being in aligned registration when said body members are in closed position, and locking means including an elongate member selectively positionable in and out of bridging reception in adjacent bores of said jaws.

12. The ski carrier of claim 11, in which said elongate member is an element of a severable loop which is completed externally of said bores.

13. The ski carrier of claim 12, in which said elongate member is a flexible cable.

14. The ski carrier of claim 13, in which the ends of said cable are external of said bores and carry separably engageable lock fittings, at least one of which is of sufficiently small diametrical extent to pass through said bores.

15. The ski carrier of claim 11, in which said elongate member is a bolt carried in one of said bores, and bolt-actuating means carried by the body member having said one bore.

16. The ski carrier of claim 15, in which said bolt-actuating means is key-operated.

17. The ski carrier of claim 15, in which said bolt is one of two carried in the bore of said other jaw, each of said bolts being movable by said bolt-actuating means in and out of bridging reception with the bore of a different one of said bifurcated projections.

18. The ski carrier of claim 1, in which each of said body members has a ski-pole-receiving cavity in the region between said axis and the handle, each ski-pole cavity being open to receive lateral insertion of the central region of a ski pole when said body members are in open position, said ski-pole cavities being effectively closed by the adjacency of said body members when in closed position.

19. A ski carrier, comprising two similar tong-like body members each having a handle at one end and a jaw at the opposite end, said members having an articulated connection on an axis located between the handle end and the jaw end, the handles being in abutting adjacency when in closed position and in angularly spaced relation when in open position, each of the jaws having a ski-receiving cavity and the cavities of said jaws facing each other to define a generally rectangular passage extending parallel to said axis and adapted to contain the combined central cross-section of a pair of skis in face-to-face relation when said body members are in closed position, each of said body members having a ski-pole-receiving cavity in the region between said axis and the handle thereof, each ski-pole cavity being open to receive lateral insertion of the central region of a ski pole when said body members are in open position, the ski-pole cavities being effectively closed by the adjacency of said body members when in closed position, and each body member including at the ski-pole-cavity region thereof a resilient pole-retaining latch formation to releasably retain an inserted ski-pole in the cavity.

20. A ski carrier, comprising two tong-like body members each having a handle at one end and a jaw at the opposite end, said members having an articulated connection on an axis located between the handle end and the jaw end, one of said members being of substantially lesser axial extent than the other of said members in both the region of said articulated connection and along the remainder of said one member to one of the ends thereof, the other of said members having a continuously framed opening at its region of articulated connection, the axial extent of said opening spanning the said lesser axial extent of said one member, and pin means engaging both members at both axial limits of said opening and providing said articulated connection with said one member received in the framed opening of said other member, each of the jaws having a ski-receiving cavity and the cavities of said jaws facing each other to define when in closed position a peripherally enclosed passage extending parallel to said axis and adapted to contain the combined central cross-section of a pair of skis in face-to-face relation when said body members are in closed position.

21. The ski carrier of claim 20, in which said lesser axial extent of said one member extends to the jaw end thereof.

22. The ski carrier of claim 21, in which each of said body members has a ski-pole-receiving cavity in the region between said axis and the handle, each ski-pole cavity being open to receive lateral insertion of the central region of a ski pole when said body members are in open position, said ski-pole cavities being effectively closed by the adjacency of said body members when in closed position.

23. The ski carrier of claim 22, in which said ski-pole cavities are both of the axial extent of said other member.

24. The ski carrier of claim 20, in which each of said members is a single piece of injection-molded plastic material.

25. A ski carrier, comprising two tong-like body members each having a ski-receiving jaw cavity at one end and a ski-pole-receiving jaw cavity at the other end, said members having an articulated connection on an axis located between the respective ends and cavities, one of said body members having a continuously framed axially extensive opening at the region of said articulated connection, the region of said articulated connection of the other of said body members having between its articulation region and one of the ends of said other body member an axial extent which is of substantially the axial extent of the framed opening, the articulated connection of said body members being at both axial limits of the framed opening, the ski-pole cavities having mutually facing open sides which are open for removable insertion of a ski pole in each of them when said body members are in open position and which are effectively closed for ski-pole retention when said body members are in closed position, the ski-receiving cavities having mutually facing open sides which are open for removable insertion of the central region of a pair of skis face-to-face when said body members are in open position and which are effectively closed for ski retention when said body members are in closed position.

26. The ski carrier of claim 25, in which said body members include coacting elements to releasably hold said members in closed position.

27. The ski carrier of claim 26, in which at least one of said body members includes a carrying handle.

28. The ski carrier of claim 25, in which each of said body members includes an open-frame carrying handle at one end, the frame openings of said handles being in registering adjacency when said members are in closed position.

* * * * *